US006420640B2

(12) United States Patent
Koch

(10) Patent No.: US 6,420,640 B2
(45) **Date of Patent: *Jul. 16, 2002**

(54) METHOD AND APPARATUS FOR GLOVE-BASED CHORDING

(75) Inventor: Mark J. Koch, Milpitas, CA (US)

(73) Assignee: Sun Microsystems, Inc., Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/841,707

(22) Filed: Apr. 23, 2001

Related U.S. Application Data

(63) Continuation of application No. 09/353,524, filed on Jul. 14, 1999, now Pat. No. 6,262,355.

(51) Int. Cl.[7] ..... G10H 1/32; G10H 3/00

(52) U.S. Cl. ..... 84/600; 84/720; 84/723; 84/745

(58) Field of Search ..... 84/600, 718, 720, 84/723, 743, 745

(56) References Cited

U.S. PATENT DOCUMENTS 4,635,516 A * 1/1987 Giannini ..... 84/600
5,046,394 A * 9/1991 Suzuki et al. ..... 84/600
5,151,553 A * 9/1992 Suzuki et al. ..... 84/600

* cited by examiner

*Primary Examiner*—Marlon T. Fletcher
(74) *Attorney, Agent, or Firm*—Gunnison, McKay & Hodgson, L.L.P.; Philip J. McKay

(57) ABSTRACT

The invention is a method and apparatus for chording. One embodiment of an apparatus comprises a user-wearable support element, in the form of a glove having finger and thumb portions. An output generating element in the form of a switch is provided corresponding to each finger and thumb portion of the glove. An activator is provided for each finger and thumb portion of the glove. In one embodiment, each activator comprises a wire having one end connected to the glove and a second end arranged to activate the switch corresponding to its respective finger or thumb portion. Movement of each finger and thumb into one or more positions causes the respective activator to activate its respective switch. In one embodiment, the outputs generated by the switches are input to a signal controller. The signal controller is arranged to provide a second output dependent upon the inputs from the various switches. In one embodiment, the second output is determined from a map and comprises alphanumeric data.

14 Claims, 2 Drawing Sheets

METHOD AND APPARATUS FOR GLOVE-BASED CHORDING

This application is a continuation of application Ser. No. 09/353,524, filed Jul. 14, 1999, now U.S. Pat. No. 6,262, 355.

BACKGROUND OF THE INVENTION

1. Field of the Invention

This invention is in the field of digital input or chording.

2. Background Art

A common means for interacting with a wide variety of devices is through one or more input devices which require manipulation by one or more fingers of a user. For example, a user may interact with a computer through the use of a keyboard. Other devices include a keypad. In these arrangements, interaction of the user with the device comprises the user depressing or activating one or more keys of the keyboard or pad.

In the case of a computer, the keyboard may be of the well-known 101-key type keyboard. Because this type of keyboard is fairly heavy and large, it is normally positioned on a support surface near a monitor of the computer which displays information to the user.

In many instances, a user wishes to interact with a computer, but wishes to do so without being constrained to using a desktop located keyboard. A number of portable computing device have been developed. For example "laptop computers" are much smaller versions of their desktop counterparts. Even these laptop computing devices, however, generally include a keyboard which is quite large. In addition, such devices still require the user to support the device and to use both hands to type the keyboard.

An input arrangement which frees a user's hand or hands is desired.

SUMMARY OF THE INVENTION

The invention is a method and apparatus for chording.

In accordance with one embodiment of the invention, the apparatus comprises a user-wearable support element, at least one output generating element, and at least one activator causing the at least one output generating element to generate an output in response to a movement of a portion of the user-wearable support element by a user.

In one or more embodiments, the user-wearable support element comprises a glove having four finger portions and a single thumb portion, the at least one output generating element comprises a switch associated with each finger and thumb portion, and the at least one activator comprises a wire having a first end connected to one of the finger or thumb portions and a second end associated with a respective switch.

In one or more embodiments, the output from each switch is inputted to a signal controller. The signal controller provides an output based on the inputs from the switches. In one embodiment, a map is associated with the signal controller, the map associating alphanumeric output with the various inputs from the switches.

In one or more embodiments of the invention, each tactile and/or audible feedback is provided to the user of the apparatus regarding the activation of each switch.

In accordance an embodiment of the invention, the method comprises the steps of moving one or more portions of the user-wearable support, causing the activator(s) to activate the one or more output generating elements. The output from these elements is provided to the signal controller, which in turn provides a second output. In one embodiment, the second output is alphanumeric representative data.

In the embodiment where the user-wearable support comprises a glove, the activators comprise wire and the output generating elements comprise switches, movement of a user's finger or thumb from a generally straight position to a bent position is arranged to cause the activator to activate the switch.

Further objects, features and advantages of the invention will become apparent from the detailed description of the drawings which follows, when considered with the attached figures.

BRIEF DESCRIPTION OF THE DRAWINGS

FIG. 3(*b*) is a side view illustrating the portion of the chording device illustrated in FIG. 3(*a*) in a second position; and FIG. 3(*c*) is a side view illustrating the portion of the chording device illustrated in FIG. 3(*a*) in a third position.

DETAILED DESCRIPTION OF THE INVENTION

Figure 1:
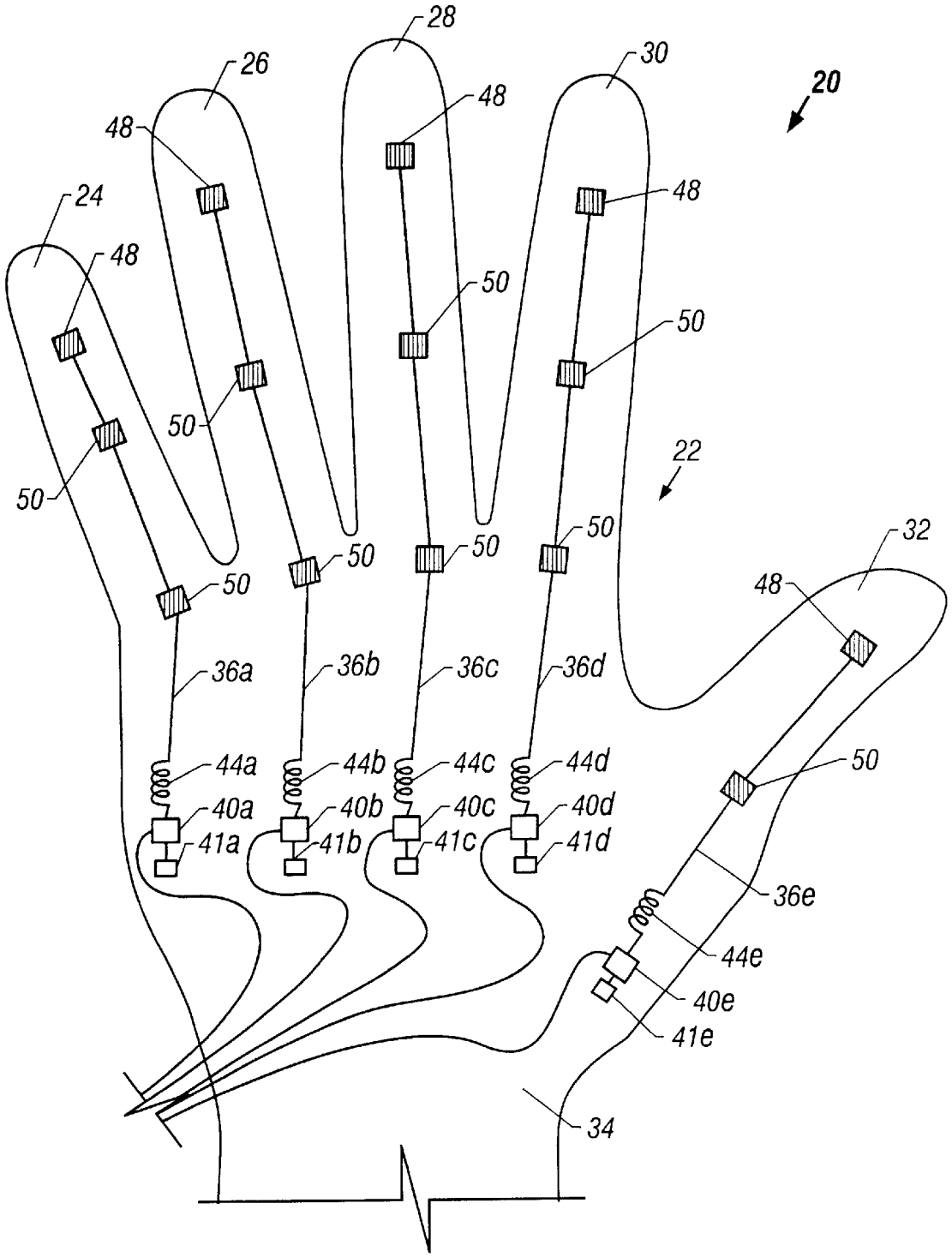
FIG. 1 is a top view illustrating a chording device in accordance with the invention.

The invention is a method and apparatus for glove-based chording. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Apparatus for Glove-Based Chording

One or more embodiments of the invention comprise a chording apparatus. An embodiment of an apparatus in accordance with the invention will be described in conjunction with FIGS. 1 and 2.

In general, an apparatus in accordance with the invention includes a user-wearable support element, one or more output generating elements, and at least one activator for activating the one or more output generating elements in response to the movement of one or more fingers or digits of a user. The support element is worn by a user and the at least one activator is arranged to activate the one or more output generating elements upon a given movement of the one or more digits of a user/wearer.

An embodiment of an apparatus 20 of the invention will be described in detail with reference first to FIG. 1. In this embodiment, the wearable support element is a glove 22 adapted to be worn on a user's hand. The glove 22 may be of a variety of configurations. As illustrated, the glove 22 includes a main portion 34 arranged to cover the body of a hand of a wearer, four finger-engaging portions 24,26,28,30 (a first portion 24 corresponding to a "pinky" of a wearer, a second portion 26 corresponding to a "ring" finger of a wearer, a third portion 28 corresponding to a middle finger of a wearer, and a fourth portion 30 corresponding to an index finger of a wearer) and a single thumb-engaging portion 32.

The glove 22 has an exterior surface. The exterior surface generally has a first or top side corresponding to the top surface of a wearer's hand, and a second or bottom side corresponding to the bottom surface (i.e. "palm") of a wearer's hand.

In one or more embodiments, the glove 22 is designed to enclose a hand of a wearer. The glove 22 may have variety of other configurations, however. For example, the glove 22 need not completely enclose the fingers and thumb of the wearer. But could comprise an open frame-like construction. The glove 22 may also be of a variety of sizes. In fact, the size of the glove 22 may be varied dependent upon the size of the hand of the intended wearer.

The glove 22 may be constructed from a wide variety of materials. It is desirable for at least the finger and thumb enclosing-portions 24,26,28,30,32 to be constructed from a flexible material. In the embodiment illustrated, the glove 22 is made from a flexible and durable fabric material.

In the illustrated embodiment, the at least one activator comprises at least one actuation wire. In one or more embodiments, an actuation wire 36*a*,36*b*,36*c*,36*d*,36*e* is provided corresponding to each finger and the thumb of a wearer of the apparatus 20, and thus each finger portion 24,26,28,30 and the thumb portion 32 of the glove 22.

At least one portion of each wire 36*a–e* is attached to the glove 22, whereby movement of a user's finger or thumb, which is transmitted to a corresponding portion of the glove 22, causes movement of the respective wire 36*a–e*. In addition, each wire 36*a–e* is arranged to activate or actuate one or more output generating devices, as described in more detail below. As illustrated, a first end of each wire 36*a–e* is connected to the glove 22, while a second end of each wire 36*a–e* is associates with an output generating device.

In one or more embodiments, the first end of each wire 36*a–e* is connected to the exterior top surface of the glove 22. Each wire 36*a–e* extends from its connection to the glove 22 generally along a corresponding finger/thumb portion 24,26,28,30,32 towards the main portion 34 of the glove. In one or more embodiments, the first end of each wire 36*a–e* is connected at or near a distal end of its respective finger or thumb portion 24,26,28,30,32. As described below, an anchor element may be provided for such a purpose.

Each wire 36*a–e* may be constructed of a wide variety of materials. As described below, each wire 36*a–e* is subject to bending along with the flexing or bending of the finger/thumb of the wearer of the device. In addition, it is desirable for each rod 36*a–e* to be durable and strong. As such, in one or more embodiments, the wires 36*a–e* comprise piano wire.

In one or more embodiments, the at least one output generating element comprises a number of switches. As illustrated, a switch 40*a*,40*b*,40*c*,40*d*,40*e* is provided corresponding to each finger and thumb of a wearer of the apparatus 20.

In one or more embodiments, each switch 40*a–e* comprises an electro-mechanical switch wherein mechanical movement or motion of a part of the switch is associated with the opening and closing of an electrical circuit. In order for wearer to know when a particular switch has been activated, as described in more detail below, each switch 40*a–e* is arranged to provide tactile feedback when it is moved between its various states. In an embodiment where each switch 40*a–e* has a first non-activated position and a second activated position, each switch 40*a–e* provides tactile feedback when moved from at least the first to the second position.

In one or more embodiments, each switch 40*a–e* is also arranged to provide audible feedback when moved between its various states. In an embodiment where each switch 40*a–e* has a first non-activated position and a second activated position, each switch 40*a–e* provides audible feedback when moved from at least the first to the second position.

The audible and tactile feedback provided by each switch 40*a–e* may be provided by the same or different means. For example, each switch 40*a–e* may be arranged so that the position of one or more mechanical elements changes when the switch is activated. In such arrangement, the movement of these one or more elements may result in a force or impact which can be felt by the user and which generates an audible sound. In one or more other embodiments, the audible feedback may be provided separately, such as by a tone generator.

As illustrated, each wire 36*a–e* is connected to its respective switch 40*a–e* in a manner which permits a user to move each finger between a first position in which the switch is not activated, a second position in which the switch is activated, and a third position in which the switch remains activated.

Referring to FIG. 1, in one or more embodiments, this is accomplished as follows. Each switch 40*a–e* comprises a frictionally-actuating or engaging switch. The wire 36*a–e* associated with a particular switch 40*a–e* extends through its respective switch and is associated with the switch in a manner whereby movement of the wire triggers or controls its respective switch.

As illustrated, a stop 41*a–e* is connected to the end of each wire 36*a–e* which extends through each switch 40*a–e*. Each stop 41*a–e* limits the travel of its respective wire 36*a–e* by engaging its respective switch 40*a–e* in a manner described in more detail below. The stops 41*a–e* may comprise a wide variety of elements, such as a small block of material affixed to the wire or an enlarged portion of the wire.

In one or more embodiments, extensible means are provided in association with each wire 36*a–e* and switch 40*a–e*. The extensible means are arranged to permit movement of a user's finger(s) after the stop 41*a–e* of the wire 36*a–e* associated therewith engages its respective switch 40*a–e*.

In one or more embodiments, each wire 36*a–e* has a first portion and a second portion. In this arrangement, the stop 41*a–e* is connected to the first portion of the wire and the second portion of the wire 36*a–e* is connected to the glove 20. In one or more embodiments, the extensible means comprises a small helical or coil type spring 44*a–e* coupling the first and second portions of each wire 36*a–e*. Each spring 44*a–e* is positioned between the second end of its respective wire 36*a–e* and switch 40*a–e*.

The springs 44*a–e* are arranged so that when a user flexes or bends a finger/thumb beyond the point where the stop 41*a–e* associated with a particular wire 36*a–e* engages its respective switch 40*a–e*, the user's finger is further permitted to move some distance.

The springs 44*a–e* may be formed integrally with the wires 36*a–e*, or comprise separate elements connecting the first and second portions of the wires 36*a–e*. In addition, as may be appreciated by those of skill in the art, the extensible means may comprise other than a spring 44*a–e*, such as a frictional slider which does not extend until a sufficient high force is applied thereto.

As described in more detail below, each wire 36*a–e* is arranged to actuate its respective switch 40*a–e* in response to appropriate movement of a user's finger(s) and/or thumb. In one or more embodiments, guide means are provided for guiding each wire 36*a–e* during a user's finger/thumb movement and to maintain each wire 36*a–e* in its proper position on the exterior top surface of the glove 22.

In one or more embodiments, the guide means includes an anchor 48 which affixes the first end of each wire 36*a–e* to its respective finger or thumb portion 24,26,28,30,32 of the glove 22. Each anchor 48 comprises an element affixed to a wire 36*a–e* and the respective finger or thumb portion 24,26,28,30,32. As described above, each anchor 48 is, in one or more embodiments, arranged to affix the first end of each wire 36*a–e* at or near a distal end of the respective finger or thumb portion 24,26,28,30,32. In an embodiment where the wire 36*a–e* comprises two portions, the end of the second portion opposite the spring 44*a–e* comprises the part of the wire which is connected to the glove 22.

In one or more embodiments, the guide means also includes at least one guide element 50 associated with each wire 36*a–e*. As illustrated, each guide element 50 comprises a tubular member having a central hollow passage through which a wire 36*a–e* extends.

In one or more embodiments, two guide elements 50 are associated with each finger portion 24,26,28,30 and a single guide element 50 is associated with the thumb portion 32 of the glove 22. A first guide element 50 is positioned near the intersection of each finger portion 24,26,28,30 and the main portion 34 of the glove 22. A second guide element 50 may optionally be positioned approximately half-way along each finger portion 24,26,28,30 of the glove. In such a position, the second guide element 50 is located at the approximate position of the first joint of each finger of a wearer (i.e. that joint closest to the knuckle of each finger). In the event one or more of the finger engaging portions 24,26,28,30,32 is short (such as where one or more of the portions do not fully enclose the fingers) the anchor(s) 48*a–e* may be positioned near enough to the main portion 34 of the glove 22 to eliminate the need for a second guide element 50.

The guide elements 50 may be attached to the glove 22 in a wide variety of manners well known in the art, such as with an anchor or the like.

The single guide element 50 which is associated with the thumb portion 32 is positioned approximately half-way therealong, and thus near the thumb joint of a wearer of the glove 22.

The guide elements 50 may be constructed of a wide range of materials. In one or more embodiments the elements 50 are constructed from metal. Durable plastic or other material may be used as well, as known to those of skill in the art.

The size of the elements 50 and their configuration may vary. It is generally desireable for the elements 50 to be small and lightweight. As such, the elements 50 may have a relatively thin wall thickness and define a passage which is only slightly larger than the wire 36*a–e* which extends therethrough. The passage is large enough, however, to permit free movement of the wire 36*a–e* with respect thereto.

Figure 2:
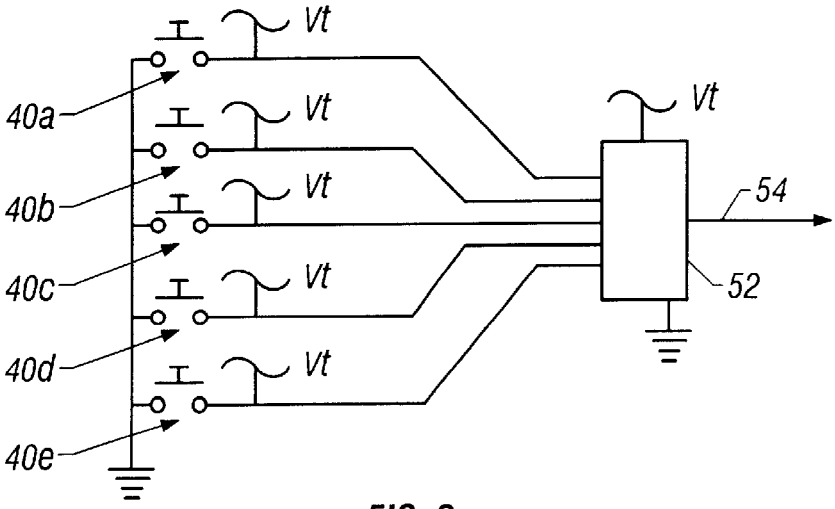
FIG. 2 diagrammatically illustrates an electrical circuit for the chording device illustrated in FIG. 1 in accordance with an embodiment of the invention.

As stated above, each switch 40*a–e* is arranged to open and close a circuit or otherwise provide an electrical signal. FIG. 2 is a simplified illustration of such a circuit. As illustrated therein, a voltage source is supplied to a first pole of each switch 40*a–e* and a ground is associated with a second pole of each switch. When the switch 40*a–e* is in its open or non-activated position, then current does not flow across the switch 40*a–e*. When the switch 40*a–e* is moved to its closed or activated position, then current is permitted to flow across the switch.

In one or more embodiments of the invention, the apparatus 20 includes one or more components for electrically coupling each switch 40*a–e* to one or more other devices. As illustrated in FIG. 2, each switch 40*a–e* is associated with a signal controller 52. In this arrangement, when a particular switch 40*a–e* is closed, an electrical signal is provided to the signal controller 52.

In one or more embodiments, the signal controller 52 is arranged to provide an output 54 dependent upon the input from the switches 40*a–e*. In one or more embodiments, the signal controller 52 includes means for providing a "coded" output based on a chording scheme. The chording scheme may vary. As well known to those of skill in the art, in accordance with such schemes, individual and combined inputs are associated with or correspond to particular outputs. For example, in accordance with one scheme, inputs provided by individual or combinations of the activated switches 40*a–e* (by movement of the appropriate fingers and/or thumb, as described below) are associated with an alphanumeric output. By way of example, activation of the switch 40*a* may cause the signal controller 52 to output a signal corresponding to the letter "A" and activation of switches 40*a*, 40*d* and 40*e* at the same time may cause the signal controller 52 to output a signal corresponding to the letter "W." In this regard, the signal controller 52 may include a map which associates various inputs with various outputs. Such a map may be provided in a memory associated with the signal controller 52.

In one or more embodiments, the output 54 is in the form of an electrical signal. The output 54 may be provided in a specific configuration. In one or more embodiments, the output 54 is in serial data form for receipt by a universal serial bus port. The output 54 may be provided through an appropriate cable which is arranged to interface with such a port of a computer, and the signal which is sent therethrough is arranged to be received through such a port. The output may be arranged in a variety of forms and provided through a variety of output devices, such as a PS/2 output arrangement or parallel port arrangement.

In the embodiment described above, the "output" from each output generating device is an electrical signal provided by a switch 40*a–e*. Of course, each output generating device may be configured to provide any number of outputs. For example, the output generating device may output a high frequency sound signal or light impulse. In such event, the signal controller 52 is arranged to receive these outputs. In the arrangement where there are five output generating devices, the outputs provided thereby are arranged to be distinguishable by the signal controller 52, such as by having each output generating device provide an output having a differing frequency.

While the switches 40*a–e* described above are illustrated in FIG. 1 as being separate elements, those of skill in the art will appreciate that the switches 40*a–e* may be combined into a single unit. In addition, while the controller 52 has been described as separate from the switches 40*a–e*, the functions of the controller 52 and switches 40*a–e* may be integrated into one or more components.

In accordance with the invention, the glove 22 may be made in a variety of sizes to accommodate different wearers. Even so, users having a wide variety of different sized hands may be accommodated in a particular sized glove. Variations in the sizes of a users' hands (including the length of the fingers and thumb) are generally associated with changes in the distance of wire 36*a–e* travel when a users fingers and thumb are bent. To accommodate these differences, in one or more embodiments, each anchor 48*a–e* may be arranged to permit adjustment of the length of its associated wire 36*a–e* between the anchor 48*a–e* and the stop 41*a–e*. If the length is increased, it accommodates a longer hand, including fingers and thumb. In one or more embodiments, the position of each stop 41*a–e* may be varied, either alone or in combination with any adjustment which may be permitted by the anchor.

Method of Chording

One or more embodiments of the invention comprises a method for chording. In one or more embodiments, the invention is a method of chording using the apparatus 20 described above.

In accordance with the method of the invention, the apparatus 20 of the invention is worn by a user. When the apparatus 20 is in the form of a glove 22 as described above, the glove 22 is worn on the hand of a user/wearer.

Figure 3:
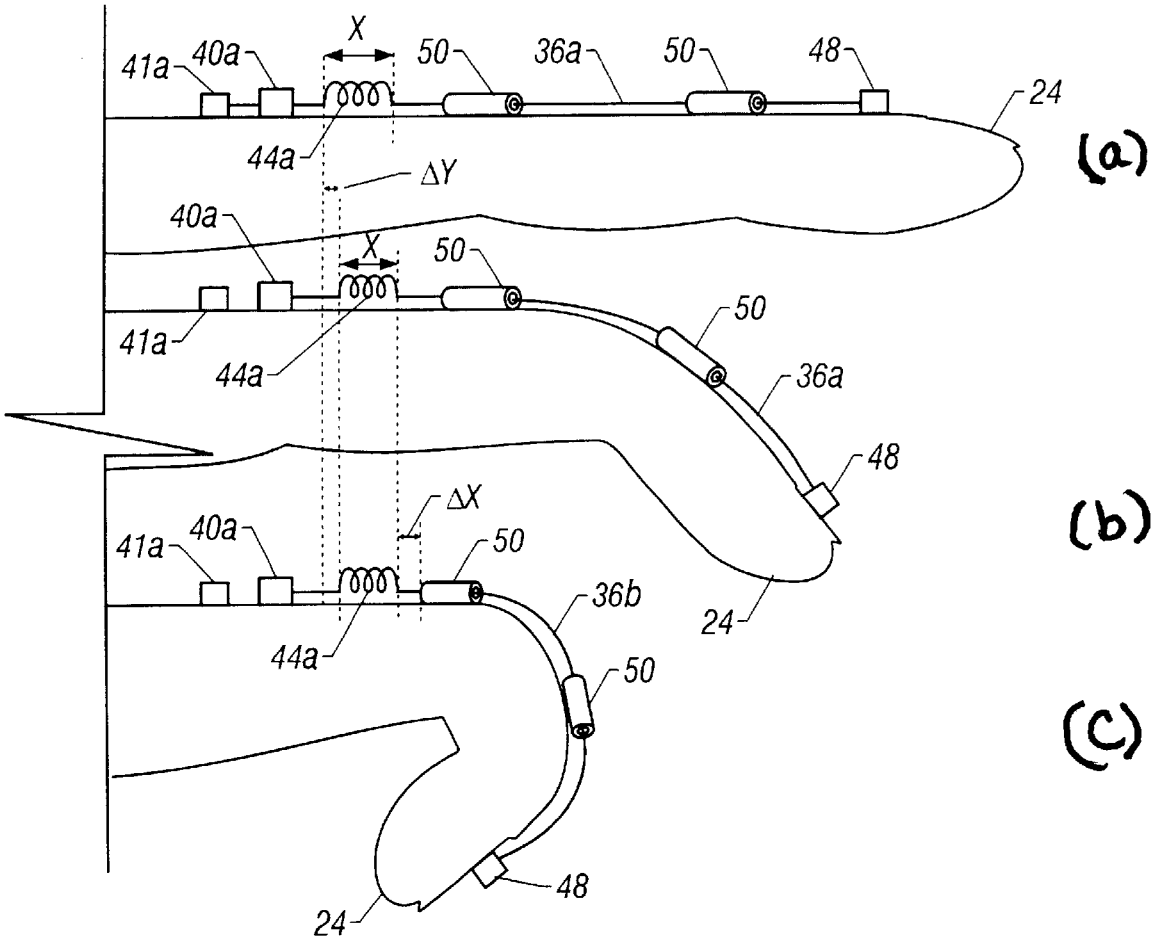
FIG. 3(*a*) is a side view illustrating a portion of the chording device illustrated in FIG. 1 in a first position.

Referring to FIGS. 3(*a*) and (*b*), movement of each finger and the thumb of the wearer causes activation of a particular switch 40*a–e*. These switches 40*a–e* provide an input to the signal controller 52, which in turn provides an output 54.

As illustrated in FIG. 3(*a*), in a resting or unbiased state, each of the wearer's fingers and thumb extend outwardly generally unbent or straight. A wearer is permitted to bend a finger or thumb (the first finger portion 24 is illustrated), by a distance delta y before the stop 41*a* engages the switch 40*a*. Just before or when the stop 41*a* engages the switch 40*a*, the switch 40*a* is arranged to be activated by movement of the wire. The distance delta y is generally chosen to be relatively small so that the user does not need to bend their fingers and/or thumb a great deal before each switch 40*a–e* is activated, permitting for fast and efficient chording.

Notably, when the user moves a finger or thumb as described above, the entire length of the wire 36*a* between its first end and the stop 41*a* (i.e. both the first and second portions of the wire 36*a* and the spring 44*a* in between) moves the distance delta y. Of course, in the event the user moves a finger or thumb, but not by a distance delta y, the switch associated therewith may not be activated. In other words, the device 20 may accommodate small twitches in the fingers or thumb of a wearer without triggering a switch.

In accordance with one or more embodiments of the invention, when a particular switch 40*a–e* is activated, tactile and audible feedback is provided to the user. In other words, the wearer is provided with an indication of the activation of each switch 40*a–e* by the sense of feeling provided through the wearer's hand and by a sense of hearing provided through one or both of the user's ears.

In accordance with the invention, the user is also provided with tactile feedback indicating how close the user is to activating a particular switch 40*a–e*. As the user approaches the point at which each switch 40*a–e* is activated, the force or pressure which the user must apply with a particular finger or thumb increases, due to the switch actuation force. This permits a user to "feel" the pressure which is necessary to activate a particular switch 40*a–e*.

In accordance with an embodiment of the invention, the method includes the step of providing the output 54 of the apparatus 20 to another device. For example, the output 54 may be provided to a computer 100. In this arrangement, the apparatus 20 may take the place of a standard keyboard, permitting the user to interact with the computer and input text and other information.

In one or more embodiments, the user may move each finger and/or thumb beyond the second or switch activated position to a third position in which the switch 40*a–e* associated therewith remains activated. Referring to FIG. 3(*c*), further bending of the finger (beyond the postion illustrated in FIG. 3(*b*) by the user results in the wire 36*a* moving to a third postion. This movement is permitted by an extension of the spring 44*a* by a distance delta x. When the user moves the finger beyond a distance delta y, the first portion of the wire is prevented from traveling further by engagement of the stop. The second portion of the wire, however, is permitted to move as the spring 44*a* extends.

In the third position, the switch 40*a–e* remains activated. Because the spring 44*a* is extensible, a user/wearer may move each finger and/or thumb to a highly bent position beyond that which is necessary to activate the switch 40*a*. This is useful if, for example, a user wishes to grip an item with a hand during a chording session.

As may be appreciated, device 20 could be arranged without springs and with the stops 41*a–e* positioned far from each switch 40*a–e*. In such an arrangement, each switch 40*a–e* would not be activated until the user bent each finger and/or thumb a great deal, which would still permit a user to pick up items and the like. This arrangement has the drawback, however, that the user must make exaggerated finger and thumb bends to activate each switch 40*a–e*, slowing greatly the rate at which the user can chord.

When the user moves a finger or thumb back to the first position, the switch 40*a–e* associated therewith is de-activated and readied for activation again by a bending movement of the finger or thumb.

A wide variety of means are contemplated for permitting the user to (1) move each finger or thumb a small distance to activate an element associated therewith and yet (2) still permit the user to have a full range of motion with each finger or thumb without causing undesired activation of the device. For example, such means may comprise a wire activator associated with a three-position switch or a two-position switch which permits a wide range of motion.

Of course, the foregoing description is that of preferred embodiments of the invention, and various changes and modifications may be made without departing from the spirit and scope of the invention, as defined by the claims.

What is claimed is:

1. A chording apparatus comprising:

a user-wearable support element comprising a glove having four finger portions and a thumb portion;

at least one output generating element comprising a switch associated with each of said finger and thumb portions;

at least one activator comprising a wire connected to each of said finger and thumb portions and associated with a respective switch of said switches associated with each of said finger and thumb portions causing the at least one output generating element to generate an output in response to a movement of a portion of the user-wearable support element by a user; and a signal controller providing a second output in response to output from said at least one output generating element, wherein:

said second output provided by said signal controller comprises data in serial form.

2. A chording apparatus comprising:

a user-wearable support element comprising a glove having four finger portions and a thumb portion;

at least one output generating element comprising a switch associated with each of said finger and thumb portions;

at least one activator comprising a wire connected to each of said finger and thumb portions and associated with a respective switch of said switches associated with each of said finger and thumb portions causing the at least one output generating element to generate an output in response to a movement of a portion of the user-wearable support element by a user; and a signal controller providing a second output in response to output from said at least one output generating element;

a map, said map associating said second output with said output from said at least one output generating element.

3. The chording apparatus in accordance with claim 2 wherein said second output comprises alphanumeric data.

4. A chording apparatus comprising:

a user-wearable support element;

at least one output generating element;

at least one activator causing the at least one output generating element to generate an output in response to a movement of a portion of the user-wearable support element by user; and means for providing tactile feedback regarding the activation of said one or more output generating elements.

5. A chording apparatus comprising:

a user-wearable support element;

at least one output generating element;

at least one activator causing the at least one output generating element to generate an output in response to a movement of a portion of the user-wearable support element by a user; and means for providing audible feedback regarding the activation of said one or more output generating elements.

6. A chording apparatus comprising:

a user-wearable support element;

at least one output generating element; and at least one activator causing the at least one output generating element to generate an output in response to a movement of a portion of the user-wearable support element by a user, wherein:

said at least one activator comprises a wire having a first end and a second end, said first end connected to said glove and said wire having a stop positioned at or near one end for limiting the movement of said wire.

7. The chording apparatus in accordance with claim 6 wherein said wire has a first portion and a second portion, said stop associated with said first portion and a spring positioned between said first and second portions.

8. A method of providing a chording output comprising the steps of:

providing a user-wearable support element having at least one output generating element associated therewith and at least one activator for activating the at least one output generating element;

moving at least one portion of said user-wearable support element from a first position to a second position;

causing said activator to activate said at least one output generating element;

providing feedback regarding activation of said at least one output generating element; and generating an output from said at least one output generating element.

9. The method in accordance with claim 8 wherein said feedback is audible and tactile.

10. The method in accordance with claim 8 including a controller and including the steps of providing said output from said at least one output generating element to said controller and providing a second output based upon said output from said at least one output generating element.

11. The method in accordance with claim 8 wherein said step of providing said second output comprises outputting alphanumeric data.

12. The method in accordance with claim 8 wherein said at least one output generating element comprises a switch and said step of causing said activator to activate said switch comprises moving said activator and moving said switch from a first position to a second position with said activator.

13. The method in accordance with claim 8 wherein said activator comprises a wire having a first portion and a second portion, a stop for limiting the travel of said first portion of the wire, said step of causing said activator to activate comprises moving said wire from a first position to a second position in which the stop is engaged.

14. The method in accordance with claim 13 wherein a spring is positioned along said wire and further including the step of moving said second portion of said wire after said stop is engaged.

* * * * *